US008878436B2

(12) United States Patent
Lucz et al.

(10) Patent No.: US 8,878,436 B2
(45) Date of Patent: Nov. 4, 2014

(54) AMALGAM HEATER FOR FLUORESCENT LAMPS

(75) Inventors: Peter Lucz, Budapest (HU); Gabor Szabo, Budapest (HU); Balazs Torok, Budapest (HU); Miklos Budai, Budapest (HU); Titusz Talalt, Budapest (HU); Jacint Gergely, Budapest (HU); Gabor Schmidt, Budapest (HU)

(73) Assignee: General Electric Company, Schenectady, NY (US)

( * ) Notice: Subject to any disclaimer, the term of this patent is extended or adjusted under 35 U.S.C. 154(b) by 147 days.

(21) Appl. No.: 13/303,536

(22) Filed: Nov. 23, 2011

(65) Prior Publication Data

US 2013/0127342 A1 May 23, 2013

(51) Int. Cl.

| | |
|---|---|
| ***H01J 1/62*** | (2006.01) |
| ***H01J 61/32*** | (2006.01) |
| ***G09G 3/10*** | (2006.01) |
| ***H01J 61/56*** | (2006.01) |
| ***H01J 61/28*** | (2006.01) |
| ***H05B 41/295*** | (2006.01) |
| ***H01J 61/52*** | (2006.01) |
| ***H01J 61/26*** | (2006.01) |

(52) U.S. Cl.

CPC ..... *H05B 41/295* (2013.01); *H01J 61/56* (2013.01); *H01J 61/28* (2013.01); *H01J 61/523* (2013.01); *H01J 61/26* (2013.01)

USPC ..... 315/115; 313/490

(58) Field of Classification Search

USPC ..... 315/115, 117, 118; 313/490, 493

See application file for complete search history.

(56) References Cited

U.S. PATENT DOCUMENTS

| | | | | |
|---|---|---|---|---|
| 5,274,305 | A | 12/1993 | Bouchard | |
| 5,828,170 | A * | 10/1998 | Nishio et al. | 313/493 |
| 5,909,085 | A | 6/1999 | Nelson | |
| 2001/0003336 | A1 * | 6/2001 | Abbott et al. | 219/543 |
| 2003/0080691 | A1 * | 5/2003 | Yasuda et al. | 315/169.3 |
| 2008/0238291 | A1 * | 10/2008 | Nagasawa et al. | 313/490 |
| 2013/0002138 | A1 * | 1/2013 | Schmidt et al. | 315/116 |

FOREIGN PATENT DOCUMENTS

| | | |
|---|---|---|
| GB | 1273663 | 5/1972 |
| JP | 2001220776 A * | 8/2001 |
| JP | 2002231007 | 8/2002 |

OTHER PUBLICATIONS

Machine translation of JP2002231007A, Aug. 16, 2002.*

Extended European Search Report and European Search Opinion dated Mar. 13, 2013 in corresponding European application No. 12193320.4.

* cited by examiner

*Primary Examiner* — Daniel D Chang

(74) *Attorney, Agent, or Firm* — Pearne & Gordon LLP

(57) ABSTRACT

A fluorescent lighting device includes an arc tube, an exhaust tube extending from the arc tube, and an amalgam. A resistive heater is located adjacent to at least one of the arc tube and the exhaust tube. A power supply circuit is operatively coupled with the resistive heater. When the fluorescent lighting device is switched from an OFF state to an ON state, the power supply circuit temporarily energizes the resistive heater, thereby heating the at least one of the arc tube and the exhaust tube while the resistive heater is energized, and automatically de-energizing the resistive heater after said heating.

10 Claims, 7 Drawing Sheets

AMALGAM HEATER FOR FLUORESCENT LAMPS

BACKGROUND OF THE INVENTION

1. Field of the Invention

The present invention relates to fluorescent lamps and devices and methods for reducing run-up in fluorescent lamps.

2. Description of Related Art

Fluorescent lamps, such as compact fluorescent lamps (CFLs), contain mercury. The mercury can be in the form of an amalgam rather than a liquid.

Fluorescent lamps exhibit "run-up" when initially turned on. Run-up refers to a gradual increasing of the lamps light output from an initial, low level to a higher, more stable level (e.g., 80% of stabilized light output from the lamp). Run-up is typically finished within the first few minutes of operation of the lamp. However, run-up can be noticeable to a user and is generally undesirable. Thus, there is a need to minimize the run-up time exhibited by fluorescent lamps.

BRIEF SUMMARY OF THE INVENTION

In accordance with one aspect of the present invention, provided is a fluorescent lighting device comprising an arc tube, an exhaust tube extending from the arc tube, and an amalgam. A resistive heater is located adjacent to at least one of the arc tube and the exhaust tube. A power supply circuit is operatively coupled with the resistive heater. When the fluorescent lighting device is switched from an OFF state to an ON state, the power supply circuit temporarily energizes the resistive heater, thereby heating the at least one of the arc tube and the exhaust tube while the resistive heater is energized, and automatically de-energizing the resistive heater after said heating.

In accordance with another aspect of the present invention, provided is a fluorescent lighting device comprising an arc tube, an exhaust tube extending from the arc tube, and an amalgam located within the exhaust tube. A resistive heater is located adjacent to the exhaust tube. A power supply circuit is operatively coupled with the resistive heater. When the fluorescent lighting device is switched from an OFF state to an ON state, the power supply circuit temporarily energizes the resistive heater, thereby heating the amalgam and the exhaust tube while the resistive heater is energized, and automatically de-energizing the resistive heater after said heating.

In accordance with another aspect of the present invention, provided is a fluorescent lighting device comprising an arc tube, an exhaust tube extending from the arc tube, and an amalgam. A resistive heating layer is located on the arc tube. A power supply circuit is operatively coupled with the resistive heating layer. When the fluorescent lighting device is switched from an OFF state to an ON state, the power supply circuit temporarily energizes the resistive heating layer, thereby heating the arc tube while the resistive heating layer is energized, and automatically de-energizing the resistive heating layer after said heating.

DETAILED DESCRIPTION OF THE INVENTION

Figure 1:
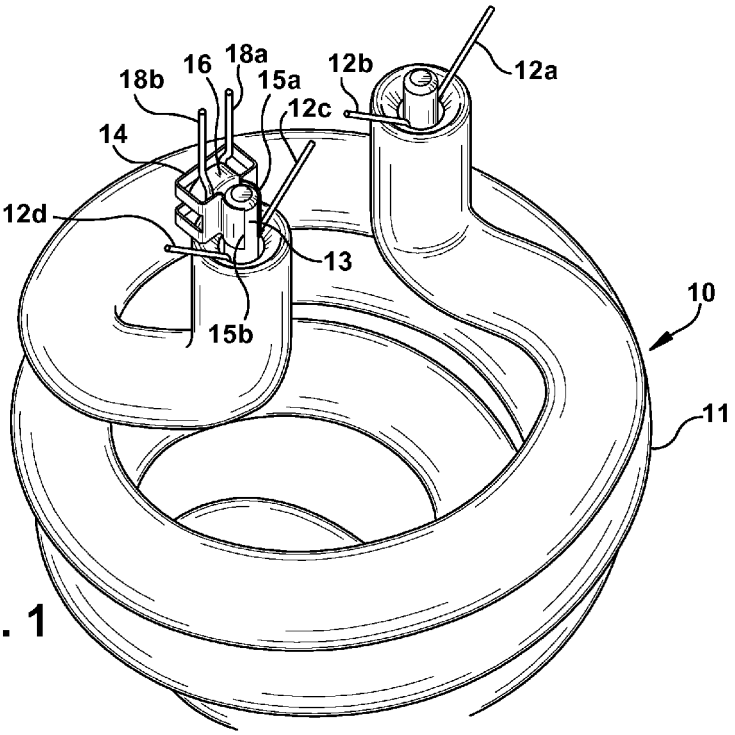
FIG. 1 is a perspective view of a portion of a compact fluorescent lamp (CFL)

The present invention relates to fluorescent lamps and devices and methods for reducing run-up in fluorescent lamps. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

FIG. 1 provides a perspective view of a portion of an example compact fluorescent lamp (CFL) 10. A base for the lamp 10, such as a screw base, is not illustrated in FIG. 10. The lamp 10 in FIG. 1 includes a spiral arc tube 11. Thus, the lamp 10 in FIG. 1 is a so-called spiral-type CFL. However, the lamp 10 need not be a spiral-type CFL, and the arc tube 11 need not be a spiral tube. For example, the lamp 10 could be a so-called tubular-type compact fluorescent having a generally rectangular, bent arc tube. Moreover, the lamp 10 need not be a CFL. For example the lamp 10 could be a linear fluorescent lamp, such as a so-called T12 lamp. Regardless of the style of fluorescent lamp, the lamp 10 includes an amalgam for providing the mercury needed for operation of the lamp 10. The lamp 10 can include both a main amalgam and an auxiliary amalgam.

Figure 13:
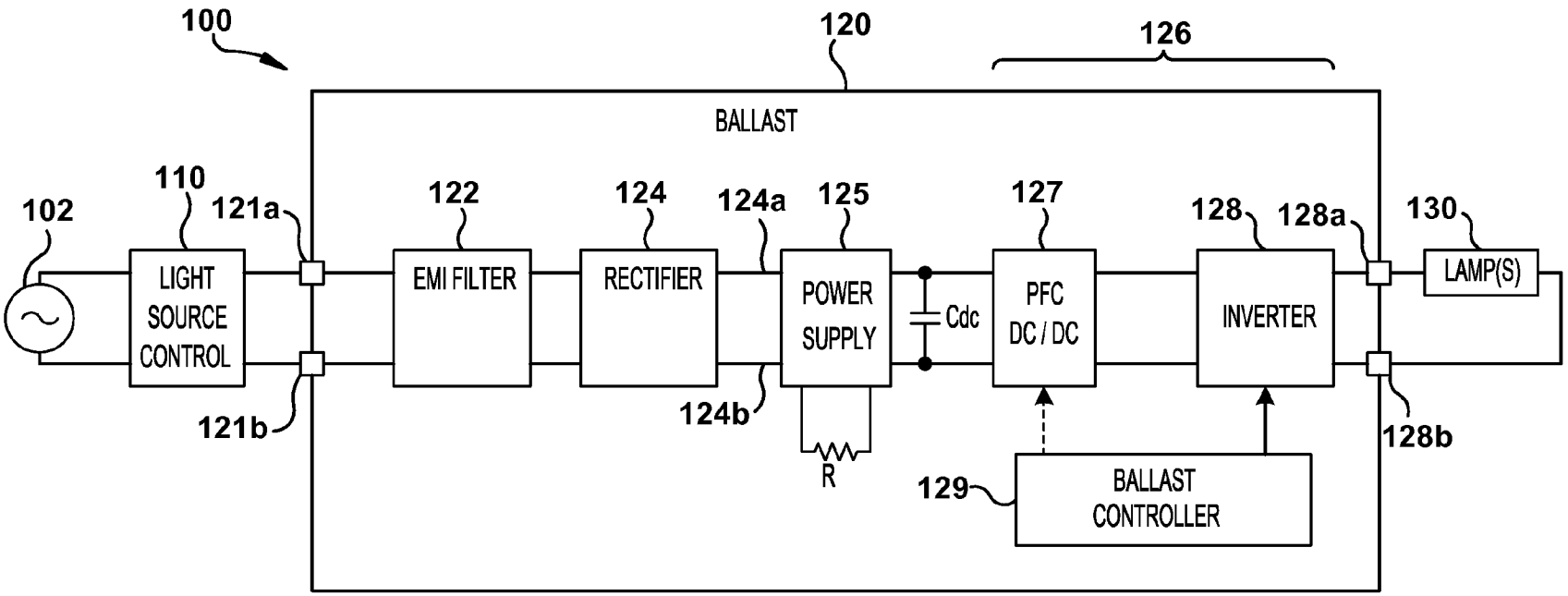
FIG. 13 is a schematic diagram showing an example ballast.
Figure 14:
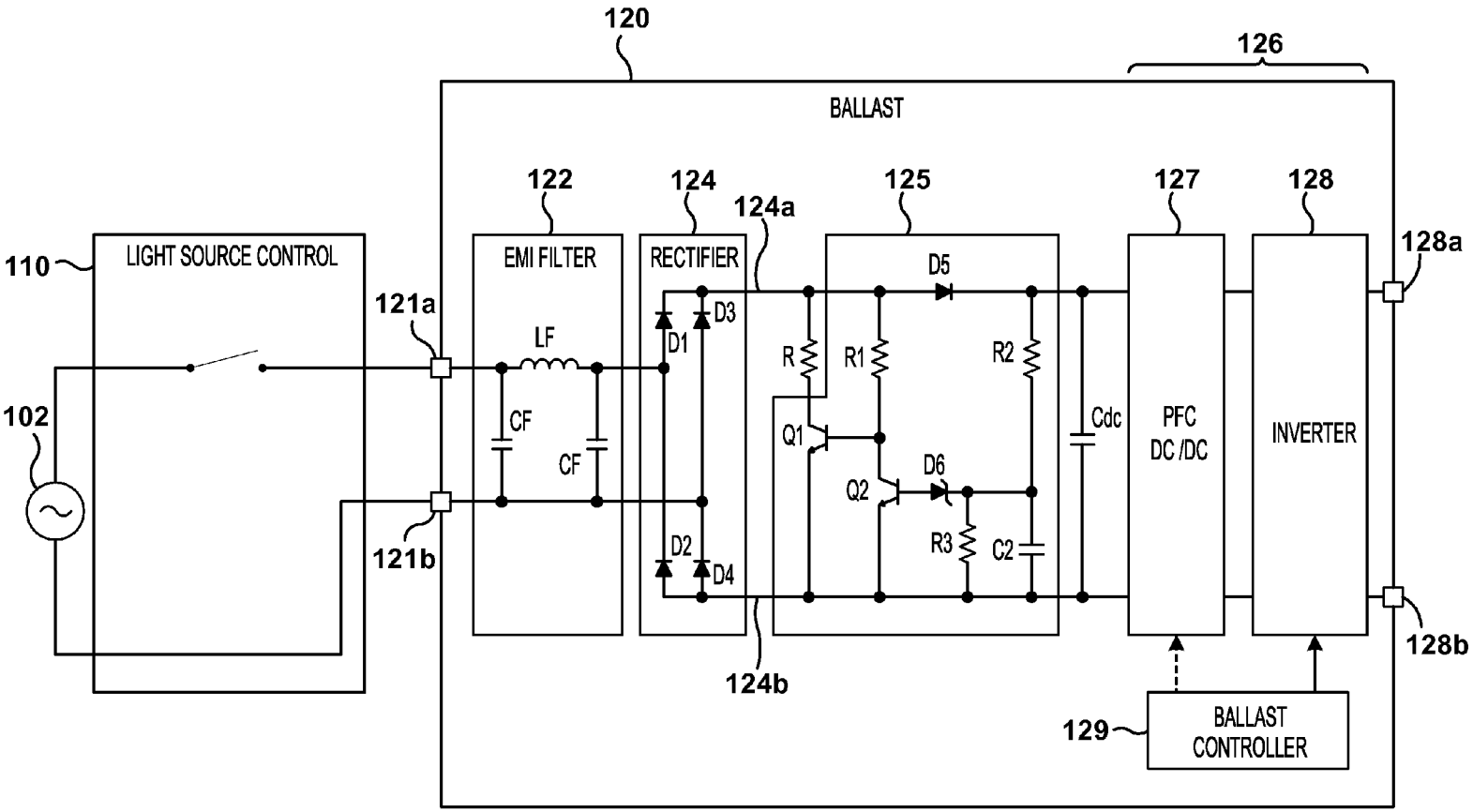
FIG. 14 is a schematic diagram showing an example ballast.

Electrical leads 12*a-d* connect the lamp 10 to output terminals 128*a*, 128*b* of a ballast 120 (see FIGS. 13, 14). The ballast 120 can be located within a base for the lamp 10, such as a screw base, or separate from the lamp as part of a light fixture.

Figure 2:
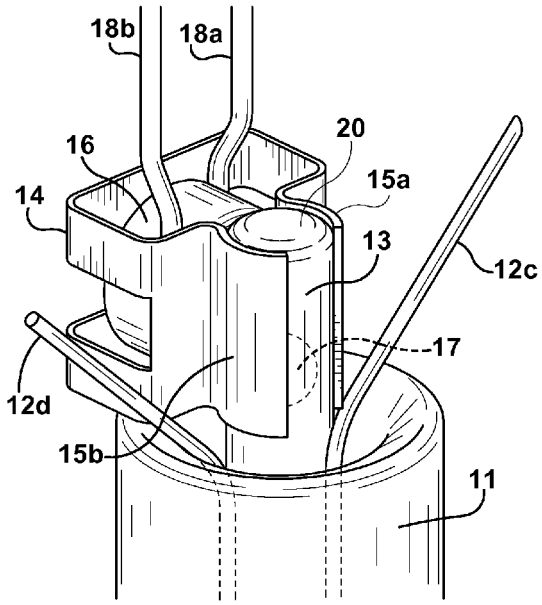
FIG. 2 is a perspective view of a portion of a CFL.

An exhaust tube 13 extends from the arc tube 11. A bracket 14 is attached to the exhaust tube 13. The bracket could be attached to the arc tube 11, or both the exhaust tube 13 and the arc tube 11. As best shown in FIG. 2, the bracket has opposing first and second arms 15*a*, 15*b* that engage the exhaust tube. The opposing first and second arms 15*a*, 15*b* conform to the shape of the exhaust tube 13. In the embodiment shown, the opposing first and second arms 15*a*, 15*b* have curved profiles that conform to the cylindrical shape of the exhaust tube 13. Other profiles for the arms 15*a*, 15*b* are possible to conform to exhaust tubes of various shapes. The arms 15*a*, 15*b* can hold the bracket in place on the lamp 10 by friction (e.g., by squeezing the exhaust tube 13), by use of an adhesive, by locking components (e.g., resilient locking tabs) or by the use of additional fasteners.

Figure 3:
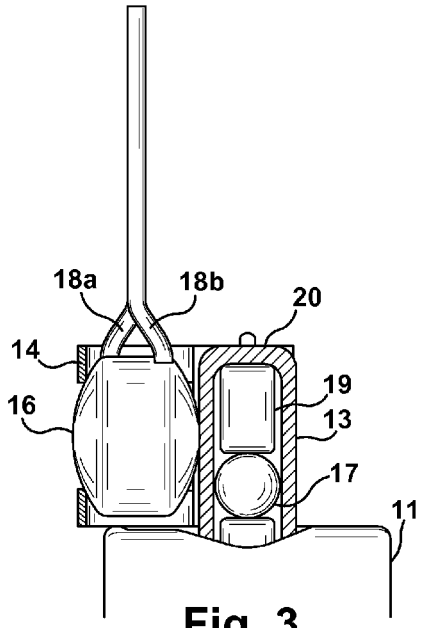
FIG. 3 is a section view of a portion of a CFL.

The purpose of the bracket 14 is to hold a resistive heater 16 such that the resistive heater 16 is mounted near the exhaust tube 13 and the amalgam 17 in the exhaust tube. When the lamp and amalgam are cool (e.g., at room temperature) and the lamp is switched from OFF to ON, the lamp initially experiences run-up while the mercury vapor pressure within the lamp increases to an operating level. In order to provide the correct mercury vapor pressure, the amalgam 17 typically must reach 100-120° C. The resistive heater 16 operates temporarily when the lamp is turned ON, to transfer heat to the amalgam 17 and the exhaust tube 13, thereby warming the amalgam 17 and the exhaust tube 13 in order to shorten the run-up of the lamp 10. In FIGS. 1-3, the amalgam 17 is located within the exhaust tube 13, and the resistive heater 16 is mounted to the exhaust tube 13 via the bracket 14. In certain embodiments, the amalgam can be located within the arc tube, and the bracket 14 and resistive heater 16 can be mounted to the arc tube.

The bracket 14 can be made from a thermally-conductive material (e.g., as opposed to an insulating material) that readily conducts heat from the resistive heater 16 to the exhaust tube 13. Thus, the bracket 14 can act as a heat bridge from the resistive heater 16 to the amalgam 17. Example thermally-conductive materials for the bracket 14 include metals, such as copper, brass or steel, in addition to other known thermally-conductive materials.

The resistive heater 16 can include one or more resistors and/or one or more positive temperature coefficient (PTC) resistances. An advantage of using a PTC resistance is that its resistance increases with temperature. Thus, a resistive heater 16 employing a PTC resistance tends to be self-regulating.

Electrical leads 18*a*, 18*b* connect the resistive heater 16 to a power supply circuit 125 in the ballast 120, such as in the manner shown in FIGS. 13 and 14. As discussed below, the resistive heater 16 temporarily receives electrical power from the power supply circuit 125 after the lamp is turned ON. For example, the resistive heater 16 receives electrical power for a predetermined time period after the lamp is turned on, such as less than 5 seconds, 5 seconds, 10 seconds, 20 seconds, 30 seconds, 60 seconds, 90 seconds 120 seconds, greater than 120 seconds, etc. The predetermined time period can be chosen so that at room temperature the lamp reaches 80% or 100% of its stabilized light output within a desired period of time. In certain embodiments, the resistive heater 16 temporarily receives electrical power until a specific light level or temperature is reached, as measured by the lighting device.

Due to its proximity to the amalgam 17 and the exhaust tube 13, the resistive heater 16 warms the amalgam and exhaust tube while energized. For example, the resistive heater 16 generates 1-10 Watt while energized. As shown in the partial section view of FIG. 3, the resistive heater 16 is mounted next to the amalgam 17 and is separated from the amalgam by the wall of the exhaust tube 13. A positioning element 19, such as a glass rod, is located within the exhaust tube and positions the amalgam 17 within the exhaust tube 13 between a sealed end 20 of the exhaust tube and the arc tube 11.

Figure 4:
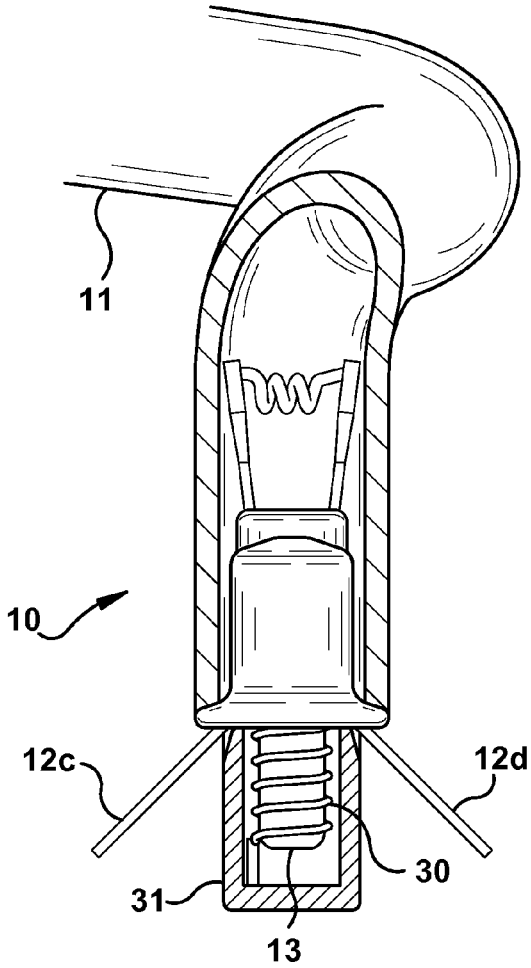
FIG. 4 is a section view of a portion of a CFL.
Figure 5:
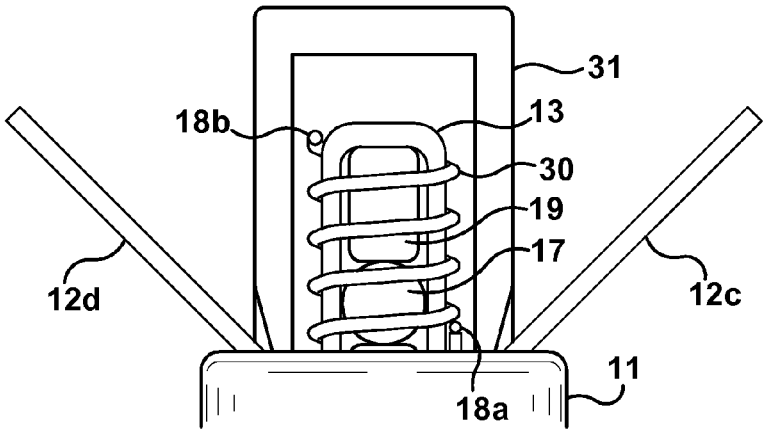
FIG. 5 is a section view of a portion of a CFL.
Figure 6:
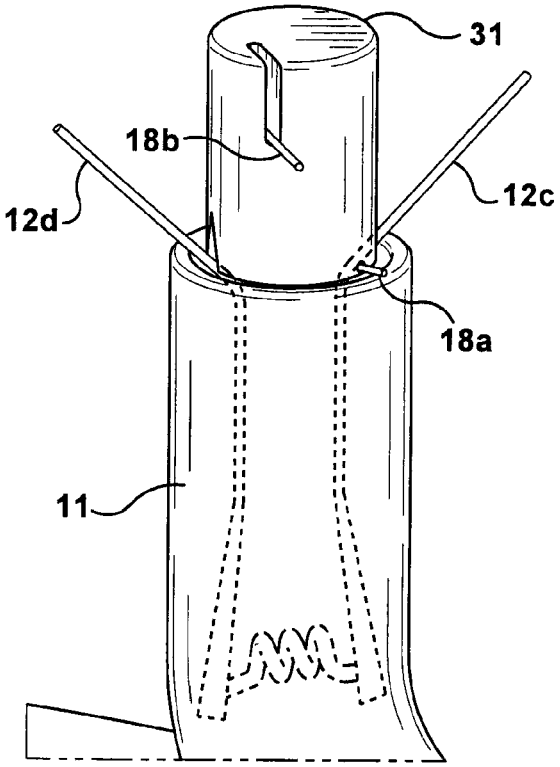
FIG. 6 is a perspective view of a portion of a CFL.
Figure 7:
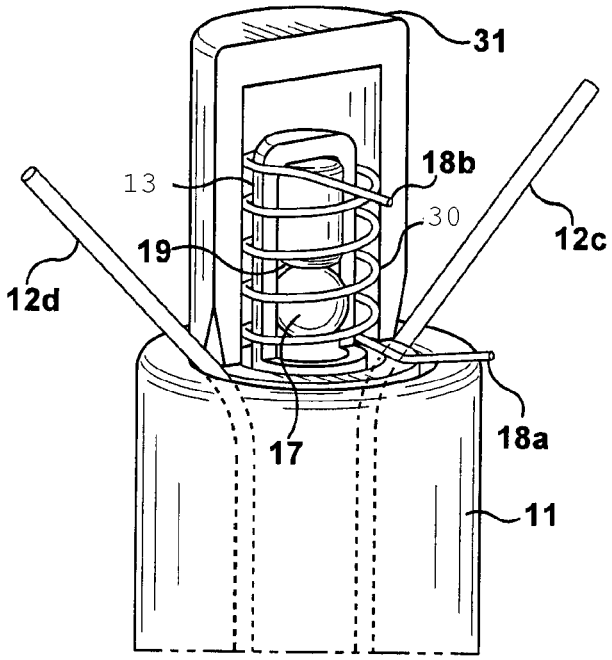
FIG. 7 is a perspective view of a portion of a CFL.

FIGS. 4-6 show an example CFL in which the resistive heater is in the form of a heating filament 30 or resistance wire attached to the exhaust tube 13, for heating the exhaust tube 13 and amalgam 17. The heating filament 30 is coiled around the exhaust tube 13 and covered with an insulating cover 31. The exhaust tube 13 can be elongated so as to be longer than a conventional exhaust tube, in order to accommodate the heating filament 30. For example, the exhaust tube 13 could be elongated by about 5-10 mm. Electrical leads 18*a*, 18*b* extend through the insulating cover 31 and connect the heating filament 30 to the power supply circuit 125 (FIGS. 13, 14) in the ballast 120. The power supply circuit 125 temporarily energizes the heating filament 30 after the lamp 10 is turned ON.

Figure 8:
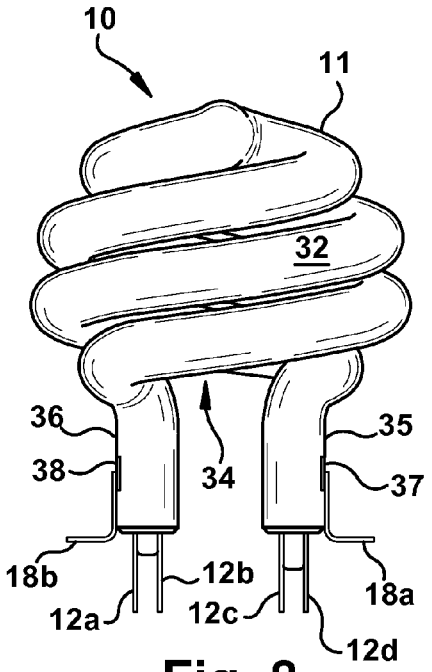
FIG. 8 is a section view of a portion of a CFL.
Figure 9A:
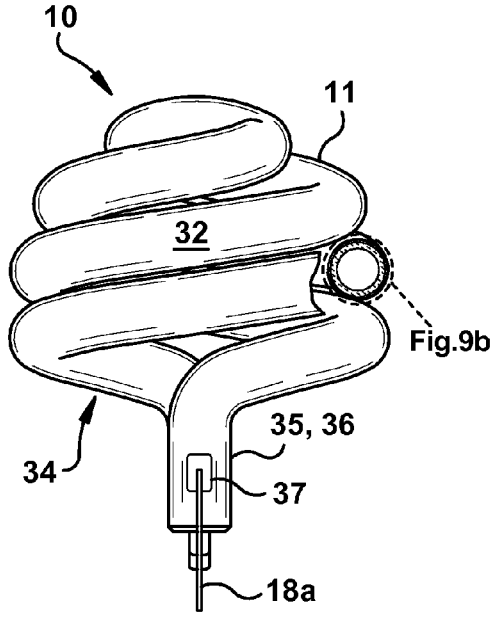
FIG. 9*a* is a section view of a portion of a CFL.
Figure 9B:
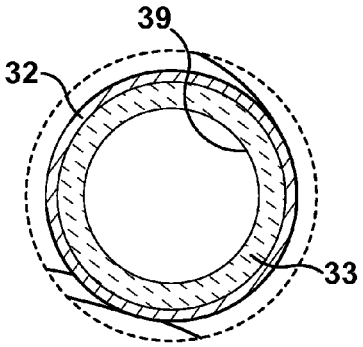
FIG. 9*b* is a section view of a portion of a CFL.
Figure 10:
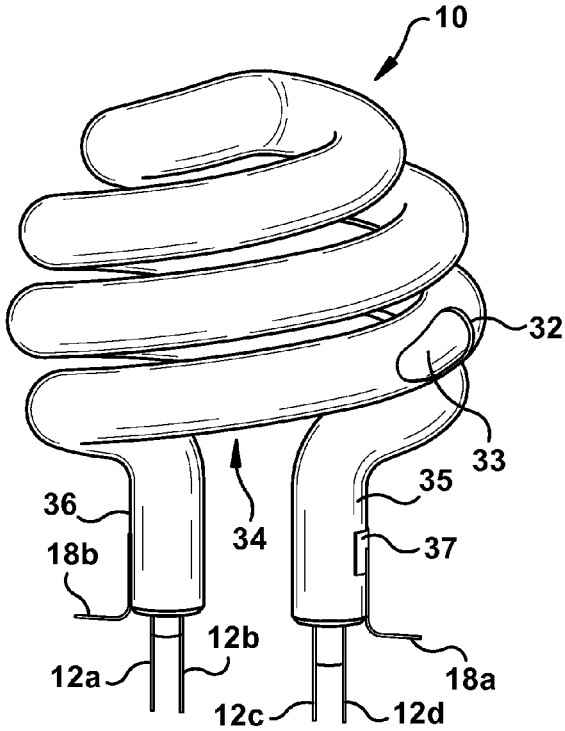
FIG. 10 is a perspective view of a portion of a CFL.

In FIGS. 8-10, the resistive heater is in the form of a heating layer 32 applied to the arc tube 11. The heating layer 32 heats the arc tube 11 and can heat the main amalgam and/or an auxiliary amalgam in the arc tube 11. Heating the arc tube 11 can help shorten the lamp's run-up by speeding up the diffusion of mercury from the amalgam. The heating layer 32 is shown as applied to the outer surface of the arc tube 11. However, the heating layer 32 could be applied to the inner surface of the arc tube 11. The heating layer 32 can be transparent or translucent to readily permit the transmission of light through the heating layer. An example material of construction for the heating layer is fluor-doped tin oxide (TFO). The heating layer 32 is shown in FIG. 9*b* in relation to the glass layer 33 that forms the arc tube 11 and a phosphor layer 39 coating the inside of the arc tube 11.

The lamp 10 has a spiraled central portion 34 and first and second substantially straight ends 35, 36. First and second heater electrodes 37, 38 are respectively located at the first and second ends 35, 36 to transmit power from the power supply circuit 125 (FIGS. 13, 14) to the heating layer 32. The power supply circuit 125 temporarily energizes the heating layer 32 after the lamp 10 is turned ON.

Instead of or in addition to a heating layer, one or more heating wires or filaments could be applied to the arc tube 11. Also, different resistive heaters can be combined on one lamp. For example, the heating layer 32 can be combined with a resistive heater 16, 30 located adjacent to the exhaust tube 13 (see FIGS. 1-7), to simultaneously heat the exhaust tube, amalgam and arc tube.

Figure 11:
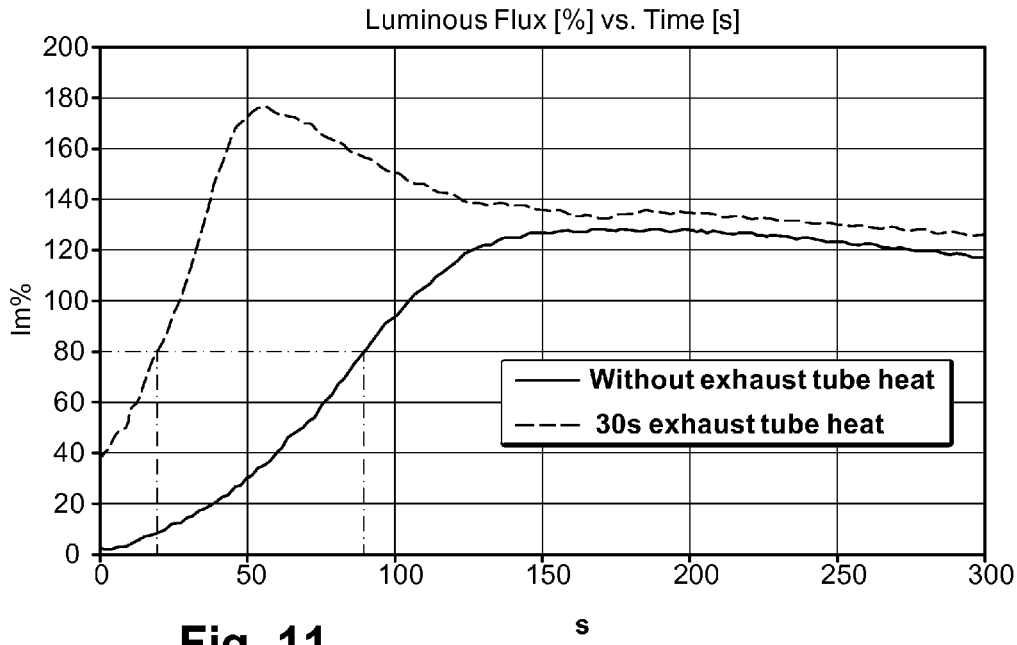
FIG. 11 is a comparative example chart showing lamp run-up.

A comparative example charting run-up measurements for a 15 W compact fluorescent lamp, with and without a resistive heater adjacent to the exhaust tube, is shown in FIG. 11. The upper curve represents the lamp having the exhaust tube heater, which is operated for 30 seconds when the lamp is turned ON. It can be seen that the initial lumen output of the lamp with the exhaust tube heater is higher than the lamp without the heater, and remains higher for the entire 300 seconds of the run-up measurement. The lamp with the exhaust tube heater reaches the 80% luminous flux level much more quickly than the lamp without the heater.

Figure 12:
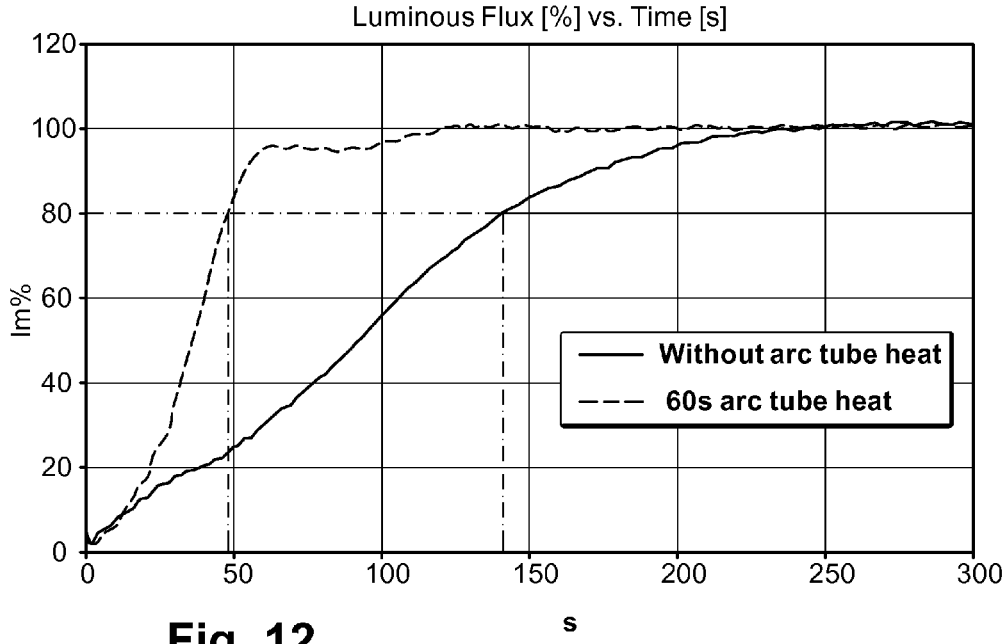
FIG. 12 is a comparative example chart showing lamp run-up.

A comparative example charting run-up measurements for a 20 W compact fluorescent lamp with and without heating applied to the arc tube, is shown in FIG. 12. The upper curve represents the lamp having the arc tube heater, which is operated for 60 seconds when the lamp is turned ON. It can be seen that the lumen output of the lamp with the arc tube heater rises more quickly than the lamp without the heater, and reaches both the 80% and 100% luminous flux levels more quickly than the lamp without the heater.

FIG. 13 illustrates an exemplary lighting system 100 including an AC power source 102 coupled with a ballast 120 through a light source control device 110, such as a dimmer or switch. The lighting system 100 includes a fluorescent lighting device comprising a ballast 120 and one or more fluorescent lamps 130. The exhaust tube, arc tube and/or the amalgam in a lamp 130 are heated by a resistive heater R powered by the power supply circuit 125. The resistive heater R in FIGS. 13 and 14 schematically represents one or more of the heaters shown in FIGS. 1-10 and described above. The ballast 120 is operable according to power provided from the source 102 to drive the one or more fluorescent lamps 130, such as CFLs. The exemplary ballast 120 is equipped with a main power conversion system as well as a ballast controller 129. The main power conversion system is operatively coupled with the AC source 102 and the control device 110 via a ballast input 121 with first and second input terminals 121*a* and 121*b* for receiving AC input power. In certain embodiments, an EMI filter 122 is coupled to the input 121. A rectifier circuit 124 is coupled with the input 121 (e.g., coupled with the first and second input terminals 121*a*, 121*b* through the EMI filter 122). The rectifier circuit 124 includes one or more passive or active rectifiers (e.g., diodes) to convert the AC input power into rectifier DC power. The DC power is provided to first and second rectifier output terminals 124*a* and 124*b*. The ballast 120 further includes an output power stage 126 having one or more power conversion circuits 127, 128 operatively coupled with the rectifier output terminals 124*a* and 124*b* to convert the rectifier DC power to provide ballast output power to the fluorescent lamp(s). In certain embodiments, a DC bus capacitance Cdc or buffer capacitance is connected between the rectifier output terminals 124*a*, 124*b* and the output power stage 126.

The output power stage 126 includes an inverter 128 to provide AC ballast output power to the fluorescent lamp(s) 130 via output terminals 128*a* and 128*b*. In certain embodiments, the output power stage 126 further includes a DC to DC converter circuit 127 coupled with the rectifier output terminals 124*a* and 124*b*. The DC to DC converter 127 can be omitted in certain ballast implementations, with the inverter 128 directly converting the output of the rectifier 124 to provide AC output power to the fluorescent lamp(s) 130. Where included, the DC-DC converter 127 can implement power factor correction (PFC) to control a power factor of the ballast 120, or power factor correction can be done in an active rectifier 124. In both situations, a ballast controller 129 is provided to regulate the output power by controlling one or both of the DC to DC converter 127 and the inverter 128.

The power supply circuit 125 for the resistive heater R is operatively coupled with the rectifier output terminals 124*a*, 124*b* and receives power from the rectifier 124. The power supply circuit 125 temporarily supplies electrical power to the resistive heater R after the lamp is turned ON. The power supply circuit 125 can include a timer that automatically switches the resistive heater R OFF upon expiration of a predetermined time period after the lighting device is switched ON. For example, the lighting device can be switched ON through a toggle switch in the light source control 110. The power supply circuit 125 will keep the resistive heater R energized for the predetermined time period (e.g., less than 5 seconds, 5 seconds, 10 seconds, 20 seconds, 30 seconds, 60 seconds, 90 seconds, 120 seconds, greater than 120 seconds, etc.) after the lighting device is switched ON, and then automatically switch the resistive heater R OFF upon expiration of the predetermined time period while the lamp(s) 130 remain ON.

FIG. 14 shows additional details of the EMI filter 122, rectifier 124, and an example power supply circuit 125. The EMI filter includes a C-L-C filter circuit with an input parallel capacitance CF, a series inductance LF and a further parallel filter capacitance CF. A passive full bridge rectifier 124 is constructed using diodes D1-D4 forming a rectifier bridge circuit receiving the AC input power through the EMI filter 122 and providing rectifier DC output power at the rectifier output terminals 124*a* and 124*b*.

The example power supply circuit 125 includes transistors Q1 and Q2. When the lighting device is switched from OFF to ON, transistor Q1 is ON (i.e., conducting) and transistor Q2 is OFF (i.e., not conducting). When transistor Q1 is ON, it conducts current from the resistive heater R. Thus, the resistive heater R is ON and its operation is controlled by transistor Q1. The predetermined time period at which Q1 turns OFF to de-energize the resistive heater R is determined by a timer established by resistor R2 and capacitor C2. When the predetermined time period established by R2 and C2 is reached, transistor Q2 turns ON, which pulls the base of transistor Q1 low, turning OFF Q1 and de-energizing the resistive heater R. Example values for R2 and C2 for operating the resistive heater R for about 7.2 seconds after the lighting device is switched ON are 330 kΩ and 22 μF.

Various timer circuits, including up and down counters, processor-based timers, timer integrated circuits, etc. could be incorporated into the power supply circuit 125 in order to establish the predetermined time period. As an alternative to a timer and de-energizing the resistive heater R upon expiration of the predetermined time period, the power supply circuit 125 could include a sensor for de-energizing the resistive heater R at a specific light level or a specific temperature level.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A fluorescent lighting device, comprising:

an arc tube;

an exhaust tube extending from the arc tube;

an amalgam;

a resistive heater located adjacent to at least one of the arc tube and the exhaust tube;

a power supply circuit operatively coupled with the resistive heater;

a bracket holding the resistive heater near the amalgam and mounted to the at least one of the arc tube and the exhaust tube, the bracket comprising opposing first and second arms having profiles that conform to the shape of the at least one of the arc tube and the exhaust tube to thereby hold the bracket in place on the at least one of the arc tube and the exhaust tube, wherein when the fluorescent lighting device is switched from an OFF state to an ON state, the power supply circuit temporarily energizes the resistive heater, thereby heating the at least one of the arc tube and the exhaust tube while the resistive heater is energized, and automatically de-energizing the resistive heater after said heating.

2. The fluorescent lighting device of claim 1, wherein the power supply circuit automatically de-energizes the resistive heater after a predetermined time period after the lighting device is switched from the OFF state to the ON state.

3. The fluorescent lighting device of claim 2, wherein the power supply circuit is included in a ballast for powering the fluorescent lighting device, wherein the predetermined time period is not greater than 60 seconds, and wherein the power supply circuit includes a transistor configured to control operations of the resistive heater, and a timer circuit configured to turn OFF the transistor after the predetermined time period.

4. The fluorescent lighting device of claim 1, wherein the resistive heater comprises a positive temperature coefficient (PTC) resistance.

5. The fluorescent lighting device of claim 1, wherein the bracket comprises a thermal conductive material that readily conducts heat from the resistive heater to the exhaust tube.

6. The fluorescent lighting device of claim 1, wherein the arc tube is a spiraled arc tube comprising:

a spiraled central portion, a first substantially straight end; and a second substantially straight end.

7. A fluorescent lighting device, comprising:

an arc tube;

an exhaust tube extending from the arc tube;

an amalgam located within the exhaust tube;

a resistive heater located adjacent to the exhaust tube; and a power supply circuit operatively coupled with the resistive heater;

a bracket holding the resistive heater near the amalgam and mounted to the exhaust tube, the bracket comprising opposing first and second arms having profiles that conform to the shape of the exhaust tube to thereby hold the bracket in place on the exhaust tube, wherein when the fluorescent lighting device is switched from an OFF state to an ON state, the power supply circuit temporarily energizes the resistive heater, thereby heating the amalgam and the exhaust tube while the resistive heater is energized, and automatically de-energizing the resistive heater after said heating.

8. The fluorescent lighting device of claim 7, wherein the power supply circuit automatically de-energizes the resistive heater after a predetermined time period after the lighting device is switched from the OFF state to the ON state, wherein the predetermined time period is not greater than 60 seconds, and wherein the power supply circuit includes a transistor configured to control operations of the resistive heater, and a timer circuit configured to turn OFF the transistor after the predetermined time period.

9. The fluorescent lighting device of claim 8, wherein the power supply circuit is included in a ballast for powering the fluorescent lighting device.

10. The fluorescent lighting device of claim 7, wherein the resistive heater comprises a positive temperature coefficient (PTC) resistance.

* * * * *